US006957553B2

(12) United States Patent
Polato

(10) Patent No.: US 6,957,553 B2
(45) Date of Patent: Oct. 25, 2005

(54) METHOD AND LINE FOR THE CONTINUOUS STRETCHING OF HIDES AND OTHER SIMILAR PRODUCTS

(75) Inventor: Antonio Polato, Mussolente (IT)

(73) Assignee: Officine di Cartigliano S.p.A., Cartigliano (IT)

( * ) Notice: Subject to any disclaimer, the term of this patent is extended or adjusted under 35 U.S.C. 154(b) by 176 days.

(21) Appl. No.: 10/475,443

(22) PCT Filed: Oct. 22, 2002

(86) PCT No.: PCT/IB02/04354

§ 371 (c)(1),
(2), (4) Date: Oct. 20, 2003

(87) PCT Pub. No.: WO03/035912

PCT Pub. Date: May 1, 2003

(65) Prior Publication Data

US 2004/0158932 A1 Aug. 19, 2004

(30) Foreign Application Priority Data

Oct. 23, 2001 (IT) ..... VI2001A0220

(51) Int. Cl.[7] ..... C14B 1/26
(52) U.S. Cl. ..... 69/19.1
(58) Field of Search ..... 69/1, 19, 19.1, 69/19.2, 19.3, 21; 8/94.1 R, 94.1

(56) References Cited

U.S. PATENT DOCUMENTS

| | | | | |
|---|---|---|---|---|
| 2,834,147 | A * | 5/1958 | Durkee | 69/19.3 |
| 4,438,570 | A * | 3/1984 | Dokoupil | 34/266 |
| 5,291,759 | A * | 3/1994 | Dokoupil | 69/19.1 |
| 6,615,621 | B1 * | 9/2003 | Stupecky | 69/19.1 |
| 6,786,067 | B2 * | 9/2004 | Stupecky | 69/19.1 |

FOREIGN PATENT DOCUMENTS

| | | |
|---|---|---|
| DE | 1 222 619 B | 8/1966 |
| DE | 39 15 042 A1 | 11/1990 |
| EP | 0 368 233 A2 | 10/1998 |
| WO | WO 00/68438 | 11/2000 |

* cited by examiner

*Primary Examiner*—Gary L. Welch
(74) *Attorney, Agent, or Firm*—R. Neil Sudol; Henry D. Coleman; William J. Sapone

(57) ABSTRACT

A method for the continuous wet stretching of industrial hides and other similar products comprises the following steps: a) removal of uniformly wetted hides following a treatment with liquids, such as tanning, re-tanning or the like, b) partial pre-drying of the wetted hides so as to reduce their residual relative moisture to a value of between 35% and 65%, c) stretching of the moist hides by means of localized mechanical stresses applied in directions which are substantially perpendicular to the plane of lie of the hides so as to achieve a predetermined increase in surface area, d) drying of the stretched hides until they have a residual relative moisture of between 7% and 30% so as to stabilize and thermally fix the stretched hides. The hides are kept in substantially constant relative humidity conditions with the mechanical stresses distributed uniformly over the entire surface area of the hides.

16 Claims, 2 Drawing Sheets

METHOD AND LINE FOR THE CONTINUOUS STRETCHING OF HIDES AND OTHER SIMILAR PRODUCTS

TECHNICAL FIELD

The present invention relates in general to the technical art of tanning and relates particularly to a method and a line for the continuous treatment of industrial hides and other similar products.

More particularly, the invention relates to a method and a line for the continuous wet stretching of industrial hides and similar products.

BACKGROUND ART

It is known that certain industrial hide treatments, such as tanning, retanning and greasing, are performed in the wet, i.e. by immersing the hides in more or less dense water, oil or grease-based liquids, which contain chemical substances of an organic or inorganic nature and have the function of inhibiting bacterial or enzymatic processes or protecting the hides and giving them a specific aesthetic appearance.

After the abovementioned treatments, the wetted hides must be dried and extended before proceeding with the subsequent processing steps.

It is also known that the surface area of the hides is a factor of vital importance for the cost-efficiency of a tannery, in that the price of the finished products—the final quality being equal—is determined on the basis of on this parameter. Therefore, one of the main objectives of tanneries is that of producing hides having the largest surface area possible, in a manner which is compatible with the other qualitative demands.

In the past, in order to perform the stretching operation, traditional straight-edge blades, which require a large expenditure of energy on the part of the operators, with limited effectiveness, were used.

This manual operation has gradually been replaced by other automatic operations, generally called "setting out", which are performed, for example, using wringing machines having spiralled cylinders arranged opposite each other. Alternatively, the hides may be pressed and stretched by means of presses provided with pairs of felt belts which act on the hides during the feeding thereof.

Another method of extending the hides consists in so-called "pasting", which envisages a paste being deposited on the coarse side of the wetted hides, said paste having the function of making said hides stick to glass, porcelain or metal plates. The hides treated in this way pass into a tunnel drier until they lose a significant proportion of their moisture. Once dried, the hides are separated and are in the form of flat sheets, ready for finishing and subsequent processing.

Another method of stretching the hides, known in technical jargon as "toggling", envisages the use of grippers or clamps applied along the edges of the hides and directed radially towards the outside. The clamps are secured to frames which keep the hides extended while they are passed through a tunnel drier or along a path in a controlled atmosphere. Optionally, the frames are provided with plates for supporting the hides in sections which can be separated, as described, for example, in U.S. Pat. No. 2,834,147. A significant drawback of said known method lies in the fact that the areas affected by the grippers are put under greater stress than the central areas, in such a way that they are irreversibly damaged, giving rise to so-called "pockets" or blisters which are due to separation and creeping of the fibres with respect to the dermis.

Moreover, the thickness of the hides is less in the gripped areas than the central areas and therefore varied stretching and thinning of the hides occurs, with consequent lower quality of the finished product.

Another known method, described in French application 2,602,795, envisages the use of a pair of flat plates on which respective elastically deformable mats, generally made of rubber, are placed. By compressing the hides between the mats arranged opposite each other and applying a longitudinal elongation thereto, a stretching of the hides through friction is achieved. Moreover, hot air, which has the function of drying the hides, is directed between the mats. Unfortunately, the heat used for heating the hides also damages the rubber mats and therefore limits their working life. Moreover, as the working temperature cannot exceed certain maximum values, the drying time increases, reducing the efficiency of the process.

Said known stretching methods have the drawback of subjecting the hides to a mechanical stretching action which is concentrated in particular along the peripheral edge thereof. When acting on said zones, which are the thinnest areas, it is necessary to restrict the magnitude of the stresses in order to avoid breakage. This restricts the increase in the surface area and therefore the effectiveness of the method.

Moreover, the stresses are not uniformly distributed and, above all, are not applied towards the centre of the hide, which has the greatest thickness and could therefore allow the greatest stretching.

British patent application 2,236,111 describes a method for increasing the total surface area of chrome-tanned or "wet blue" tanned hides, which envisages the moist hides being placed on a flat surface and being subjected to a simultaneous action of longitudinal traction, by means of grippers, and compression by means of rollers displaced longitudinally with an alternating motion which is repeated following rotation of the hides through about 90° C. This treatment allows an increase in surface area of about 10%.

However, even this solution, like the preceding solutions, does not eliminate the problem of mechanically stressing the peripheral zones of the hides and not achieving a uniform stretching thereof.

Moreover, the application of this method does not allow stretching of the fibres towards the central part thereof and therefore the liquids absorbed in this zone are retained for longer than in other zones, increasing the drying times.

DISCLOSURE OF THE INVENTION

The object of the present invention is that of overcoming the problems described above by providing a method and a line for the stretching of hides which allows a significant increase in surface area to be achieved.

A particular object of the present invention is that of devising a method and a line for stretching hides when moist, which allows uniform stretching of the hides to be performed in order to achieve finished hides of substantially constant thickness.

A further particular object is that of providing a method and a line for stretching hides which do not envisage mechanically stressing and retaining the hides in their peripheral zones and that of avoiding the concentration of stresses in these delicate zones, reducing the risks of the damage and rejection thereof.

These objects, as well as others which will emerge more clearly hereinafter, are achieved by a method for the continuous wet stretching of industrial hides and other similar products comprising the steps of a) removal of uniformly wetted hides following a treatment with liquids, such as tanning, retanning or the like, b) partial drying of the wetted hides so as to reduce their residual relative moistness to a value of between 35% and 65%, c) stretching of the moist hides by means of localised mechanical stresses applied in directions which are substantially perpendicular to the plane of lie of the hides so as to achieve a predetermined increase in surface area, d) drying of the stretched hides until they have a residual relative moistness of between 7% and 30% so as to stabilise and thermally fix the stretched hides, characterized in that, during step c) of stretching, the hides are kept in substantially constant relative humidity conditions and in that said mechanical stresses are distributed over the entire surface area of individual hides in a substantially uniform manner without any constraining along the peripheral edge thereof so as to achieve a radial stretching over their entire surface area.

According to a second aspect of the invention, a line for the continuous stretching of industrial hides, for implementing the abovementioned method is envisaged.

DETAILED DESCRIPTION OF A PREFERRED EMBODIMENT

Figure 1:
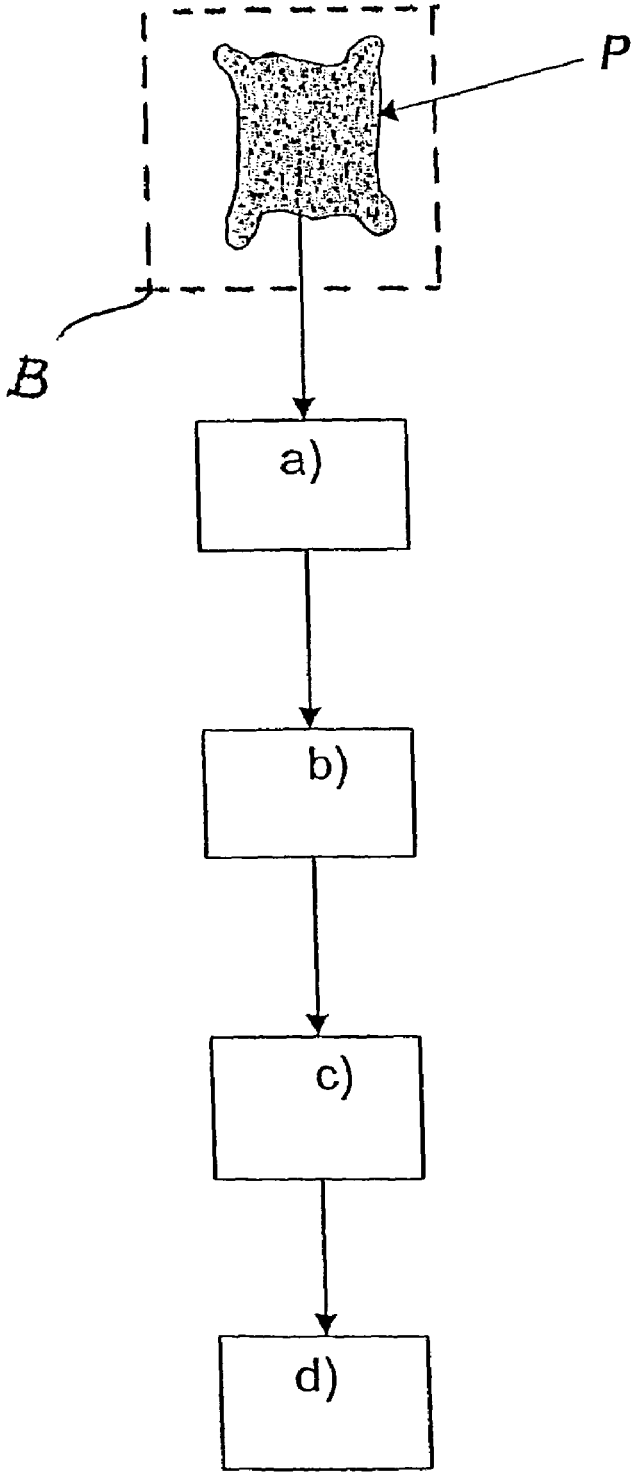
FIG. 1 shows a block diagram which illustrates the continuous method for the stretching of moist hides according to the invention.

With reference to the attached drawings, FIG. 1 shows a block diagram illustrating the method for stretching moist hides according to the invention. The method essentially comprises four steps, denoted respectively by a), b), c), d).

In step a), the hides P, which are removed from a tanning or retanning drum or from a grease-dressing bath, shown in schematic form by the letter B, have a residual relative moistness of between 85% and 100%.

In these conditions, the hides P are particularly pliable and lend themselves to being stretched with minimal risks of breakage or local damages, significantly reducing the risk of "blisters" and other local defects.

The hides are then subjected to a step b) consisting in partial drying, for example using traditional methods of wringing performed with a wringing machine or a felt stretching press. This step is regulated in such a way that the hides have a residual relative moistness with values of between 35% and 65%.

At this point, a step c) is envisaged, involving stretching the hides P when moist by means of localised mechanical stresses applied in directions which are substantially perpendicular to the plane of lie of the hides, so as to achieve a predetermined increase in the surface area.

Conveniently, according to the invention, during the stretching step c), the hides P are kept in substantially constant relative humidity conditions, corresponding to the humidity on leaving the partial drying step b). In other words, during this step, the hides must not lose their initial moistness so as not to lose their pliability when moist.

In addition to this, it is important that the mechanical stresses are distributed over the entire surface area of the individual hides in a substantially uniform manner. It is equally important that the hides are mechanically stressed without applying any constraints, i.e. without any gripper or clamp near the peripheral zones thereof, so as to leave the hides free to stretch radially in a substantially uniform manner over their entire surface area.

The stretching step c) is preferably performed until an increase in surface area or "footage" of between 2% and 25%, according to the type of wet treatment performed previously, is achieved.

In a number of practical tests carried out on chrome-tanned bovine hides with an average thickness of about 1.2 mm, an increase of about 4–5% in the footage of the hides subjected to the method according to the invention was achieved, compared to the same hides which were not wet treated. With chrome-tanned hides of greater thicknesses having a relative moistness close to 50%, increases in footage of over 10% were achieved.

By increasing the value of the relative moistness to over 65%, no benefit in terms of increase in footage is achieved, while the difficulties of working on the moist hides increase in an unacceptable manner. When performing the wet stretching step on bovine hides of considerable thickness, an increase in surface area of up to and more than 10%, compared to the same untreated hides, may be achieved.

Conveniently, the localised mechanical stresses are exerted on both sides of each hide P at uniformly distributed and substantially equidistant points of their surface area.

Preferably, the mechanical stresses are imparted by means of tools acting on opposite sides of the hides to be stretched so as to produce substantially radial tensions in localised areas centred on said points.

In a preferred constructional form, the mechanical stresses may be performed using a staking machine with beating plates. In this case, the plates are provided with tools which act in directions substantially perpendicular to the plane of extension of the hides, with application of a substantially constant operating frequency and feeding between a pair of continuous conveyor belts.

Preferably, the working frequency of the staking machine is between 200 and 1,200 strokes a minute and the feed speed of the conveyor belts is between 2 and 15 m/min.

At the end of the mechanical stressing step c), there follows a step d) involving drying and thermal fixing of the stretched hides until said hides have a residual relative moistness of between 7% and 30% so as to stabilise and thermally fix the stretched hides.

It is important that the mechanically stretched hides are conveyed to step d) for drying and thermal fixing within a predetermined maximum standing time so as to prevent the wetted hides from shrinking, adversely affecting in an irreversible manner the successful outcome of the stretching step without thermal fixing. The value of said maximum standing time is preferably between 6 seconds and 15 minutes and is preferably between 1 minute and 3 minutes. In fact, beyond said maximum time, it was found that the increases in footage achieved are lower than those mentioned above.

According to a second aspect of the invention, a line for the wet preparation of industrial hides which implements the method described above is envisaged. The preparation line according to the invention, denoted as a whole by reference number 1, may be inserted upstream of a semi-automatic hide processing line, for example of the type described and claimed in international patent application WO-A-96/15275 in the name of the present applicant.

The preparation line 1 is fed with wetted hides P leaving a tanning or retanning drum, generally indicated 2.

The line 1 comprises a drying machine 3 for the partial drying of the wetted hides P, for example formed by a wringing-stretching press, model PRC4 RA 3200, produced by the company BAUCE of Trissino (Vicenza). The hides P leaving the machine 3 will preferably have a relative moistness of between 35% and 65%.

A stretching machine, denoted in schematic form by 4, for the radial stretching of the moist hides, is located downstream of the drying machine 3.

Conveniently, the machine 4 may be formed by a staking machine with beating plates of the type called Syncro 3200 produced by the present applicant. The staking machine 4 is provided with stretching tools which act in directions substantially perpendicular to the plane of lie of the hides P without retaining the peripheral edges thereof. Conveniently, the tools may comprise a first series of pins which have rounded heads and are fixed to one of said plates and a second series of pins which are similar to those of the first series and are fixed to the other of said plates.

The pins of the first series and those of the second series may be fixed to the respective plates in mutually staggered positions so as not to interfere with each other in the position of maximum approach of the plates with the hide in between. Alternatively, the tools may be formed by a series of pins with rounded heads on one of the beating plates and a series of holes with a slightly larger diameter than the pins on the other plate so as to allow the hides to be placed in between. The pins and the holes are substantially aligned so as to allow their mutual penetration in the position of maximum approach of the plates.

In order to facilitate feeding of the hides, the stretching machine or staking machine 4 is provided with a pair of conveyer belts—not shown in the drawings—which are mutually facing and substantially horizontal.

A peculiar characteristic consists in the fact that said belts are made of water-repellent and non-absorbent materials so as to prevent the drainage of and impregnation with liquids contained in the hides P which are being processed. In this way, it is possible to keep the relative moistness of the hides P substantially constant, allowing the footage of the hides being processed to be increased uniformly. Moreover, coloured hides do not impregnate the belts, also preventing the transfer of colouring liquids on to other hides introduced afterwards.

Lastly, a drying machine 5 for drying and stabilising the stretched moist hides and reducing their relative moistness to a value of between 7% and 30% is located downstream of the stretching machine 4.

Figure 2:
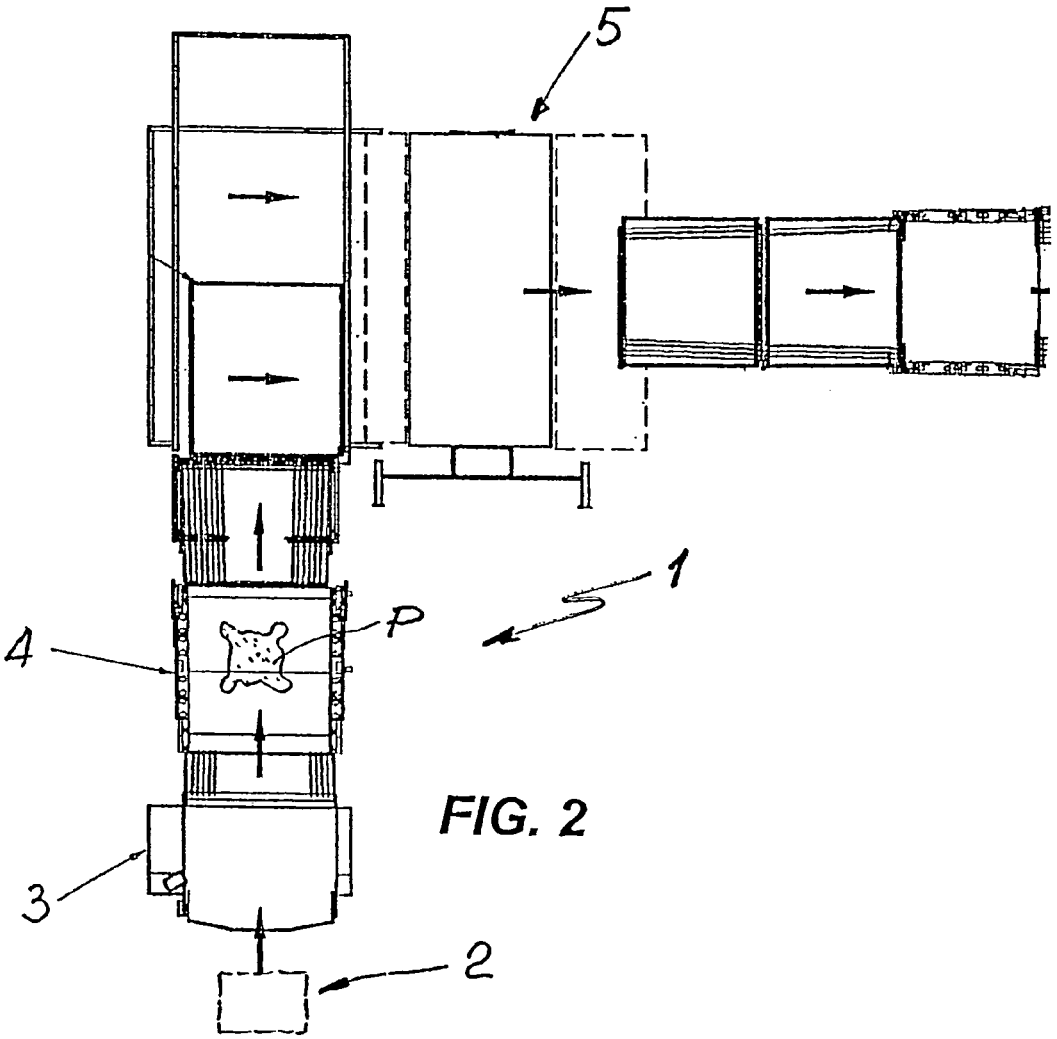
FIG. 2 shows a plan view of an embodiment of a processing line capable of performing the method as shown in FIG. 1.
Figure 3:
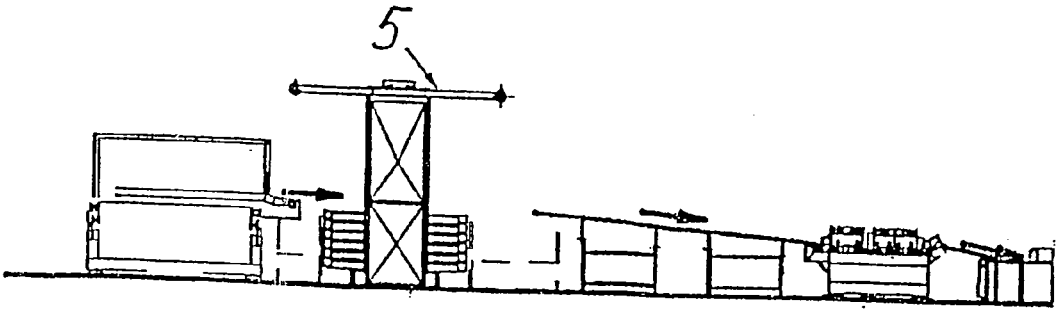
FIG. 3 shows a side view of the line as shown in FIG. 2.

In the example shown in FIG. 2, a drying machine formed by a vacuum drier with heated working surfaces, for example the model called "SV Nuovo Turbo" produced by the present applicant, is shown.

It can be easily understood that even very small increases in footage, in the region of 4%, result in a significant economic benefit, which amortizes in a short time the cost of the plant. In fact, if the method according to the invention with a 4% increase in the final footage is applied to a hide processing line with a capacity of about 100 hides/hour, considering each hide to have an average footage of about 50 square feet, working in a shift of about 8 hours/day, a total footage of about 40,000 square feet/day and an average daily increase of about 1,600 square feet is achieved.

Assuming an average cost of the hides of about 3.6 Euros/square foot, it is possible to envisage a saving of over 5,700 Euros/day, which will allow the cost of a continuous preparation line according to the invention, comprising a pre-drying machine and a staking machine, to be paid back easily in about 2–3 months.

From the foregoing, it can be understood that the method and the preparation line according to the invention achieve the predetermined objects and particular attention is drawn to the increase in footage with uniform quality and a substantially constant final thickness, without any defects and without the risk of damage near the edges of the hide.

The method and the wet preparation line according to the invention may be subject to numerous modifications and variants, all of which fall within the inventive idea described in the accompanying claims.

Moreover, all the details may be replaced by technically equivalent elements and the dimensions, forms and materials used may of any type according to the requirements.

The instant application is based upon and claims priority of patent application No. VI2001A000220, filed on Oct. 23, 2001 in Italy, the disclosure of which is hereby expressly incorporated here in reference thereto.

What is claimed is:

1. Method for the continuous wet stretching of industrial hides and other similar products, comprising the following steps:

a) removal of uniformly wetted hides following a treatment with liquids, such as tanning, retanning or the like;

b) partial pre-drying of the wetted hides so as to reduce their residual relative moistness to a value of between 35% and 65%;

c) stretching of the pre-dried hides by means of localised mechanical stresses, applied in directions substantially perpendicular to the plane of lie of the hides so as to achieve a predetermined increase in surface area;

d) drying of the stretched hides until they have a residual relative moistness of between 7% and 30% so as to stabilise and thermally fix the stretched hides;

characterized in that, during the stretching step c), the hides are kept in substantially constant relative humidity conditions and in that said mechanical stresses are distributed over the entire surface area of the individual hides in a substantially uniform manner without any constraining in their peripheral zones, so as to achieve substantially uniform radial stretching over their entire surface area.

2. Method according to claim 1, characterized in that the stretching step c) is performed in such a way that the resultant increase in surface area is between 2% and 25% depending on the type of wet treatment performed beforehand.

3. Method according to claim 1, characterized in that said localised mechanical stresses are exerted on both sides of each hide at uniformly distributed and substantially equidistant points.

4. Method according to claim 3, characterized in that said mechanical stresses are exerted by means of tools which act on opposite sides of the hides to be stretched so as to produce substantially radial tensions in localised areas centred on said points.

5. Method according to claim 4, characterized in that said mechanical stresses are achieved by means of a staking machine with beating plates which act in directions substantially perpendicular to the plane of extension of the hides with a substantially constant frequency and with a pair of continuous conveyer belts for the continuous feeding of the hides along said surface.

6. Method according to claim 5, characterized in that the working frequency of said staking machine is between 200 and 1,200 strokes a minute.

7. Method according to claim 5, characterized in that the feeding speed of said conveyer belts is between 2 and 15 m/min.

8. Method according to claim 1, characterized in that the maximum time which elapses between the end of said stretching step c) and the start of said drying step d) is between 6 seconds and 15 minutes and is preferably between 1 minute and 3 minutes.

9. Line for the continuous wet stretching of industrial hides for implementation of the method according to one or more of the preceding claims, comprising in succession:

means for transfer of the wetted hides (P) leaving a device (2) for treatment with liquids, such as a drum for tanning, retanning or the like;

machine (3) for the partial drying of the wetted hides (P) suitable for reducing their relative moistness to a value of between 35% and 65%;

a stretching machine (4) for the radial stretching of moist hides, in which said machine comprises stretching tools which act in directions substantially perpendicular to the plane of lie of the hides without retaining the peripheral edges thereof so as to perform a substantially radial and uniformly distributed stretching, and a pair of facing conveyer belts for feeding the hides, said belts being made of water-repellent materials selected so as to keep the moisture of the hides being processed substantially constant and prevent impregnation with the liquids contained in the hides during their mechanical stressing;

a machine (5) for drying and thermally fixing the stretched moist hides which is suitable for reducing their relative moistness to a value of between 7% and 30%.

10. Line according to claim 9, characterized in that said stretching machine (4) is essentially a staking machine with at least one pair of beating plates and with said tools arranged on at least one of said plates.

11. Line according to claim 10, characterized in that said tools comprise a first series of pins which have rounded heads and are fixed to one of said plates and a second series of pins which are similar to those of the first series and are fixed to the other of said plates.

12. Line according to claim 11, characterized in that the pins of the first series and those of the second series are fixed to said plates in mutually staggered positions so as not to interfere with each other in the position of maximum approach of the plates with the hide in between.

13. Line according to claim 10, characterized in that said tools comprise a series of pins with rounded heads on one of said plates and a series of holes with a slightly larger diameter than said pins on the other of said plates so as to allow the hide to be placed in between.

14. Line according to claim 13, characterized in that said pins and said holes are substantially aligned so as to allow their mutual penetration in the position of maximum approach of said plates.

15. Line according to claim 9, characterized in that said machine (5) for drying and thermally fixing the stretched moist hides is essentially a vacuum drier or a continuous hide conditioner.

16. Line according to claim 9, characterized in that a semi-automatic line for dry finishing of the stretched hides is envisaged downstream of said machine (5) for drying and thermally fixing the stretched moist hides.

* * * * *